US010099282B2

(12) United States Patent
Masuta et al.

(10) Patent No.: US 10,099,282 B2
(45) Date of Patent: Oct. 16, 2018

(54) LOW-PRESSURE CASTING METHOD AND LOW-PRESSURE CASTING APPARATUS

(71) Applicant: Nissan Motor Co., Ltd., Yokohama-shi, Kanagawa (JP)

(72) Inventors: Tatsuya Masuta, Yokohama (JP); Kenji Hayashi, Yokohama (JP); Hidetoshi Shiga, Yokohama (JP); Shinichi Tsuchiya, Yokohama (JP)

(73) Assignee: Nissan Motor Co., Ltd., Yokohama-shi, Kanagawa (JP)

( * ) Notice: Subject to any disclaimer, the term of this patent is extended or adjusted under 35 U.S.C. 154(b) by 0 days.

(21) Appl. No.: 15/541,333

(22) PCT Filed: Jan. 15, 2015

(86) PCT No.: PCT/JP2015/050947
§ 371 (c)(1),
(2) Date: Jun. 30, 2017

(87) PCT Pub. No.: WO2016/113879
PCT Pub. Date: Jul. 21, 2016

(65) Prior Publication Data

US 2017/0348768 A1 Dec. 7, 2017

(51) Int. Cl.

| | |
|---|---|
| ***B22D 18/04*** | (2006.01) |
| ***B22D 18/06*** | (2006.01) |
| ***B22D 18/08*** | (2006.01) |
| ***B22C 9/06*** | (2006.01) |
| ***B22C 9/12*** | (2006.01) |
| ***B22D 27/15*** | (2006.01) |
| ***B22C 1/18*** | (2006.01) |
| ***B22C 9/18*** | (2006.01) |

(52) U.S. Cl.
CPC ..... *B22D 18/04* (2013.01); *B22C 1/18* (2013.01); *B22C 9/06* (2013.01); *B22C 9/18* (2013.01); *B22D 18/08* (2013.01); *B22D 27/15* (2013.01); *B22C 9/12* (2013.01); *B22D 18/06* (2013.01)

(58) Field of Classification Search
CPC ..... B22D 18/04; B22D 18/06; B22D 18/08; B22C 9/06; B22C 9/12
USPC ..... 164/61, 63, 65, 256, 257, 258
See application file for complete search history.

(56) References Cited

U.S. PATENT DOCUMENTS 4,641,703 A * 2/1987 Voss et al. ..... B22D 18/06 164/255
4,957,153 A * 9/1990 Chandley ..... B22D 18/04 164/160.1
5,492,165 A 2/1996 Erana et al.
(Continued)

FOREIGN PATENT DOCUMENTS

DE 10014591 C1 8/2001
EP 0296074 A1 12/1988
JP 1986123458 A 6/1986
(Continued)

*Primary Examiner* — Kevin P Kerns
(74) *Attorney, Agent, or Firm* — Young Basile Hanlon & MacFarlane, P.C.

(57) ABSTRACT

A low-pressure casting apparatus includes a core that together with a mold forms a cavity and a reduced-pressure dryer configured to dry the core under reduced pressure. The core is disposed in the mold, the molded is closed, the core is dried under reduced pressure, and thereafter the cavity is filled with molten metal.

9 Claims, 11 Drawing Sheets

(56) References Cited

U.S. PATENT DOCUMENTS 6,422,293 B1 7/2002 Comarteau et al.

FOREIGN PATENT DOCUMENTS

| | | | |
|---|---|---|---|
| JP | H05146862 | A | 6/1993 |
| JP | H06182520 | A | 7/1994 |
| JP | H08033944 | A | 2/1996 |
| JP | H0952150 | A | 2/1997 |
| JP | H11226697 | A | 8/1999 |
| JP | 2004330287 | A | 11/2004 |
| JP | 2012176424 | A | 9/2012 |
| JP | 2014136245 | A | 7/2014 |
| WO | 2013111708 | A1 | 8/2013 |

* cited by examiner

LOW-PRESSURE CASTING METHOD AND LOW-PRESSURE CASTING APPARATUS

TECHNICAL FIELD

The present invention relates to a low-pressure casting method and a low-pressure casting apparatus. In more detail, the present invention relates to a low-pressure casting method and a low-pressure casting apparatus that can prevent gas defects.

BACKGROUND

Molten metal that is discharged from a melting furnace has high cleanliness since inclusions such as hydrogen gas, oxides and intermetallic compounds are removed by a flux treatment and degassing. However, in low-pressure casting methods, the cleanliness of the molten metal is gradually decreased, since contact between molten metal and air is inevitable.

A core, which is disposed inside a mold, contains water, resin and the like. Such water, resin and the like are vaporized by the heat of molten metal to produce gas. When such gas is left inside a molded product, it causes a gas defect or a shrinkage cavity so that the quality of the molded product is decreased.

In particular, since water also produces hydrogen gas that causes hydrogen embrittlement of a molded product, it is important to remove water and the like that are vaporized by heat of molten metal in order to improve the quality of the molded product.

However, water is also included in the air, and some air is taken into a cavity when the mold is opened. Further, in order that a core to be disposed inside a mold does not contain water, it is necessary to store the core in a humidity-controlled room, which requires a large cost for the storage of cores.

Although it is not related to low-pressure casting, JP H08-33944A discloses installing a pipe for suctioning gas inside the bodies of a mold and a core made of casting sand, and vacuuming the bodies of the mold or the core to partly reduce the pressure while supplying molten metal to a cavity, so as to suction gas that is generated from the bodies of the mold and the core. It discloses that this method can prevent gas that is produced by thermal decomposition of an organic binder contained in the mold and the like, from penetrating into molten steel, and thereby can prevent gas defects.

Although it is not related to low-pressure casting either, JP 2014-136245A discloses using an adsorbent such as zeolite or ALC instead of a technique of feeding hot air to a cavity to dry a sand mold that defines the cavity, since such techniques can remove only water that is present in the surface layer of the sand mold.

That is, it discloses surrounding the casting sand of the mold by the adsorbent such as zeolite or ALC and allowing the adsorbent to adsorb and remove water of the casting sand even to the inner part. Further, it also describes forming a core, if employed, from a sand mold of casting sand, an adsorbent embedded inside the sand mold and a reinforcing steel embedded inside the adsorbent.

However, in the method of JP H08-33944A, the molten metal may be suctioned into gaps between the casting sand to cause a sand mark, or insufficient pressure reduction may cause a gas defect.

That is, it is difficult to uniformly reduce the pressure in the bodies of the mold and the core, and the inner pressure of the mold and the like tend to vary. Further, gas from the mold and the like is not only derived from the organic binder but also produced from water contained in the mold and the like. Since the water content changes depending on the storage environment of the mold and the like, it is also difficult to estimate the amount of gas to be produced by pouring molten metal beforehand.

In the method of JP 2014-136245A, the adsorbent has a certain capacity with regard to the amount of adsorption, and it is necessary to store the mold and core so that the mold and core do not absorb water over the capacity of adsorption of the mold and core. Furthermore, it requires considerable manpower to produce the mold and core, which increases the cost.

The present invention has been made in view of these problems with the prior art. It is an object of the invention to provide a low-pressure casting method and a low-pressure casting apparatus that do not require any special processing, such as piping, other than shaping of a mold and a core, while it can reduce gas produced by heat of molten metal so as to prevent gas defects and shrinkage cavities, and it facilitates storage of the core.

As a result of a keen study for achieving the above-described object, the present inventors have found that the above-described object can be achieved in a low-pressure casting method by reducing the pressure in a cavity to dry a core after disposing the core in a mold and closing the mold and before filling the mold with molten metal. The present invention has been thus completed.

SUMMARY

The present invention is based on the above-described finding, and the low-pressure casting method of the present invention is characterized by disposing a core in a mold, closing the mold, drying the core in the mold under reduced pressure, and thereafter filling the cavity with molten metal.

The low-pressure casting apparatus of the present invention includes a core that together with a mold forms a cavity and a decompressor configured to dry the core under reduced pressure, wherein the core is disposed in the mold, the mold is closed, the core is dried under reduced pressure, and thereafter the cavity is filled with molten metal.

In the present invention, the core is dried by reducing the pressure in the mold, before the cavity is filled with molten metal, and thereby removing water therein. This reduces production of gas such as water vapor due to heat of the molten metal and thereby prevents gas defects and shrinkage cavities. Furthermore, it is possible to provide the low-pressure casting method and the low-pressure casting apparatus that prevent gas production to achieve the stable running behavior of the molten metal so as to produce high-quality molded products and that facilitate storage of the core and the like.

DETAILED DESCRIPTION OF THE EMBODIMENTS

The low-pressure casting method and the low-pressure casting apparatus of the present invention will be described in detail.

The present invention involves disposing a core in a mold, reducing the pressure in a cavity to remove water and the like contained in the core to dry it, thereafter filling the cavity with molten metal to cast a molded product, and opening the mold to collect the molded product.

The drying of the core starts from the surface. Then, when the water content of the surface is decreased, water transfers from the inner part where the water content is high to the surface and is evaporated from the surface. The evaporation and transfer are repeated so that the core is dried thoroughly to the inner part.

Accordingly, the higher the water transfer rate from a high-water content part to a low-water content part, the more rapidly the core is dried. That is, the larger the difference in water vapor partial pressure or the higher the temperature of the core, the higher the drying speed of the core.

In typical low-pressure casting apparatuses, a molded product is produced by communicating a holding furnace storing molten metal with a cavity in a mold disposed above the holding furnace through a stalk, increasing the pressure in the holding furnace to fill the cavity with the molten metal through the stalk, and allowing the molten metal to solidify.

In such low-pressure casting apparatuses, since the heat of the molten metal is supplied to the cavity through the stalk, the core is heated and water is evaporated from the surface when the mold is closed. Then, when the temperature of the inner part of the core is increased, the water in the inner part of the core is vaporized so that the pressure in the inner part is increased.

By reducing the pressure in the cavity, it is possible to dry the core rapidly thoroughly to the inner part, since the increased pressure difference between the inner part and the outer part of the core makes the water in the inner part of the core rapidly transfer to the surface.

Therefore, it is not necessary to adjust the water content of the core beforehand, which facilitates storage of the core. Furthermore, the casting time (cycle time) is not increased due to the drying step of the core.

Figure 1:
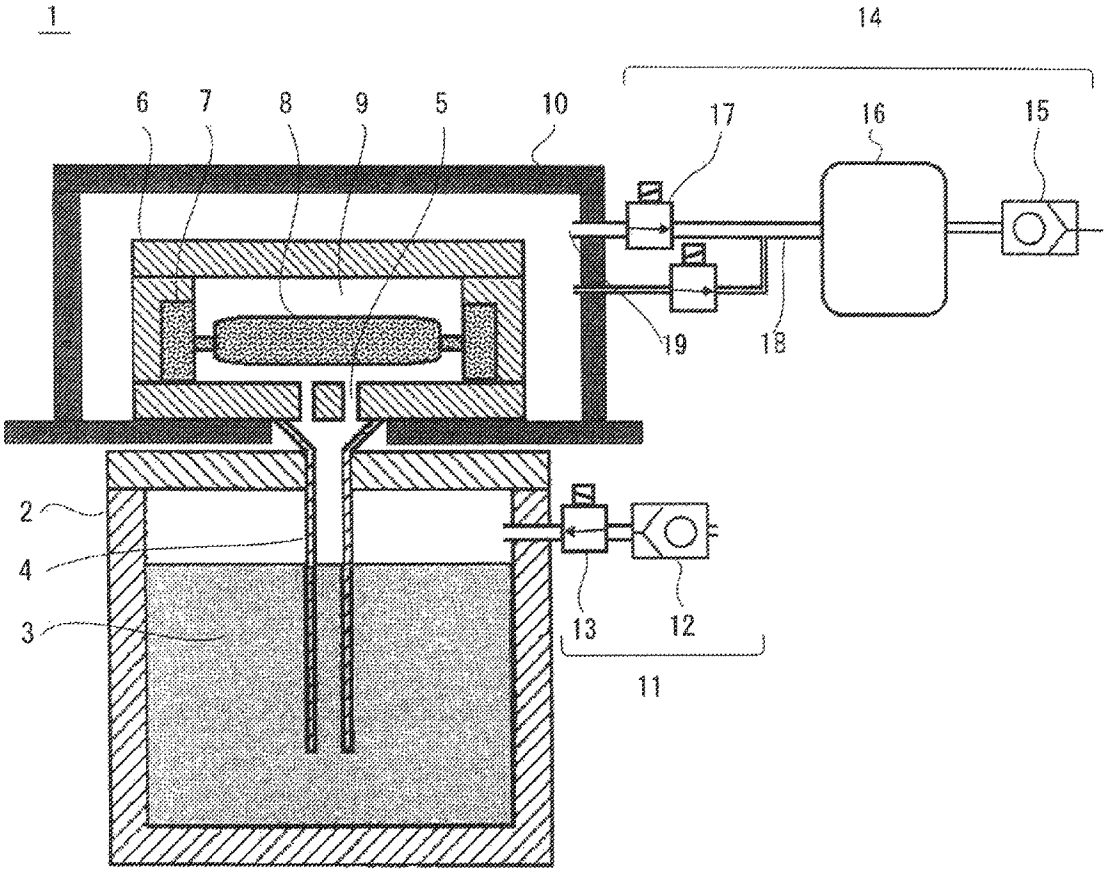
FIG. 1 is a schematic view of an example of a low-pressure casting apparatus of the present invention.

FIG. 1 is a cross sectional view of an example of the low-pressure casting apparatus of the present invention. A low-pressure casting apparatus 1 is configured such that the lower end of a stalk 4 is dipped in molten metal 3 in a hermetically closed holding furnace 2, and a gate 5 is provided at the upper end of the stalk 4.

Above the holding furnace 2, a mold 6 is disposed which is splittable into upper and lower parts. In the mold 6, a core 8 is accommodated and is positioned by a core print 7. The mold 6 and the core 8 form a cavity 9. The entire mold 6 may be covered with a chamber 10. The chamber 10 can reduce heat dissipation and thereby improve the heat efficiency.

The holding furnace 2 is provided with a compressor 11 which pumps or discharges inert gas such as carbon dioxide into or from the holding furnace to adjust the pressure in the holding furnace so as to fill the cavity with the molten metal 3 through the stalk 4. The compressor 11 includes a compression pump 12, a valve 13, a pressure sensor (not shown) and the like.

A decompressor 14, which dries the core under reduced pressure, is composed of a decompression pump 15, a decompression container 16, a valve 17, a suction pipe 18 and the like, in which the suction opening 19 of the suction pipe 18 is disposed in the chamber 10 and/or the mold 6. It is preferred suction openings 19 are provided at different locations.

The core in the mold may be dried under reduced pressure as illustrated in FIG. 1 by reducing the pressure in the chamber 10 covering the entire mold 6 so as to reduce the pressure in the mold through the gap between the splittable mold 6. Alternatively, the core may be dried as illustrated in FIG. 2 by directly reducing the pressure in the cavity 9.

Figure 3:
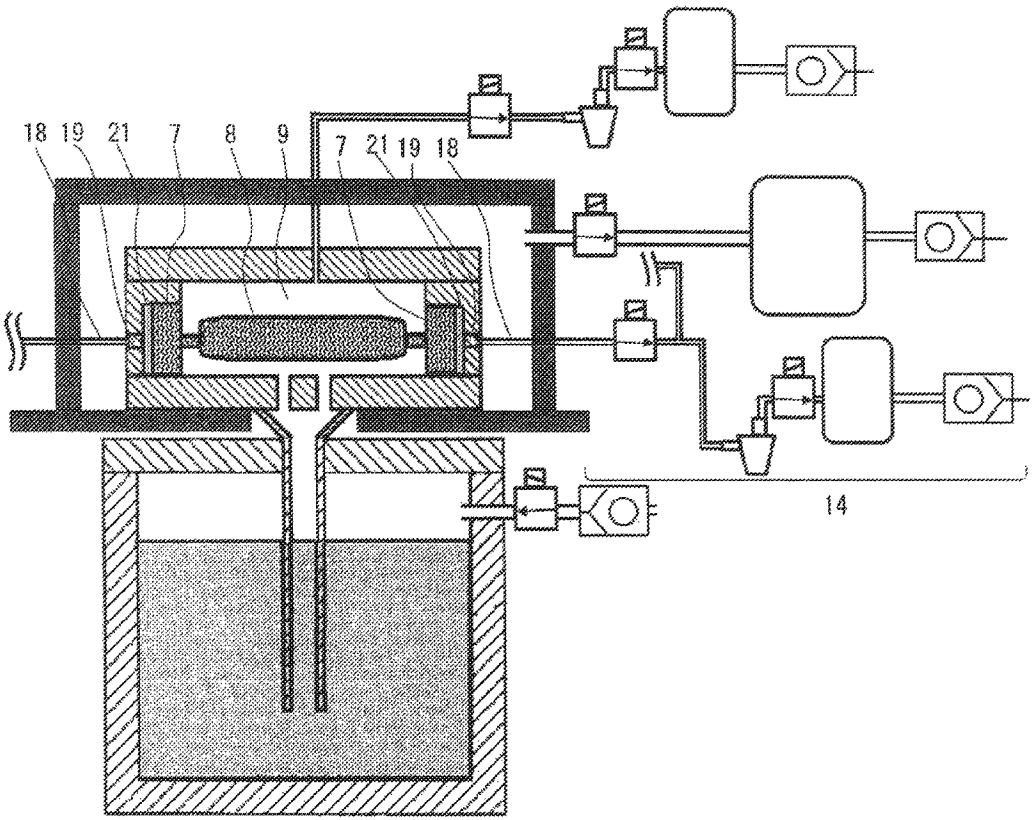
FIG. 3 is a schematic view of yet another example of the low-pressure casting apparatus of the present invention.

Furthermore, the core 8 may be dried under reduced pressure as illustrated in FIG. 3 by vacuuming the core 8 through a porous body 21 that is disposed at the location of the core print 7 for fixing the core 8 in the mold. The core may be dried by their combination.

In the low-pressure casting method, the mold 6 is closed and the cavity 9 is vacuumed. This allows the mold to serve as a drying chamber for the core 8, and the core 8 can therefore be dried efficiently.

Figure 2:
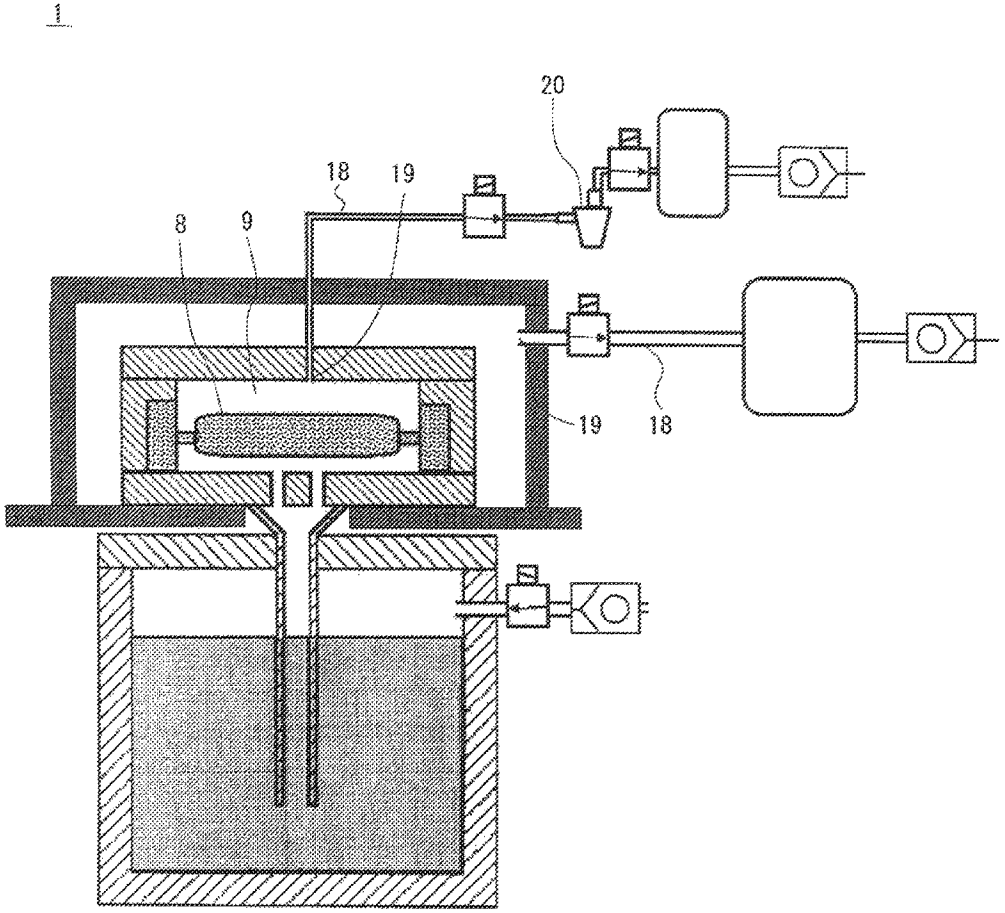
FIG. 2 is a schematic view of another example of the low-pressure casting apparatus of the present invention.

To reduce the pressure in the mold, the pressure in the chamber 10 may also be reduced as illustrated in FIG. 2 and FIG. 3 in addition to directly reducing the pressure in the cavity 9. This reduces the pressure difference between the chamber 10 and the cavity 9 and can thus prevent a leakage of the air in the chamber 10 to the cavity 9 even when the mold 6 splittable into the upper and lower parts does not achieve a completely hermetic condition.

Along with or separately from the decompression of the cavity, the core may be dried under reduced pressure by means of suction through the core print. The suction through the core print allows directly suctioning the water from the inner part of the core to dry it. Further, this also facilitates the heat transfer from the molten metal to the inner part of the core and can thereby improve the drying speed of the core 8.

When the core 8 is vacuumed through the porous body 21 to dry it under reduced pressure, a gas purging path connected to the porous body may be provided inside the core 8 and the core print 7. The suction through this route allows water to be evaporated not only from the vicinity of the core print 7 but also from the entire inner part of the core. This can further improve the drying speed of the core 8.

It is preferred that the decompressor 14, which is directly connected to the cavity 9, vacuums the cavity 9 not only in the reduced-pressure drying step of drying the core 8 under reduced pressure but also in the casting step when the cavity 9 is filled with the molten metal 3. By vacuuming the cavity 9 also while filling it with the molten metal 3, it is possible to suction gas that is produced by thermal decomposition of an organic binder or the like of the core 8. This can not only prevent gas defects but also achieve the stable running behavior. Therefore, it is possible to obtain a high-quality molded product.

When the core 8 is dried under reduced pressure before the cavity 9 is filled with the molten metal 3, the pressure in the cavity 9 is preferably from the atmospheric pressure to 0.75 atmospheres, more preferably from 0.9 atmospheres to 0.75 atmospheres, although it depends on the size of the core 8, the temperature of the molten metal 3, the air-tightness of the mold and the like. The pressure being less than 0.75 atmospheres may have a negative influence such as the decreased temperature of the preceding molten metal at the start of the casting, since the molten metal rises excessively in the stalk.

Next, the low-pressure casting method using the above-described low-pressure casting apparatus 1 will be described.

First, in a condition in which a predetermined amount of molten metal 3 is stored in the holding furnace 2, the mold 6 is opened, the core 8 is disposed in the mold along with the core print 7 for positioning the core in the mold, and the mold 6 is closed.

Figure 4:
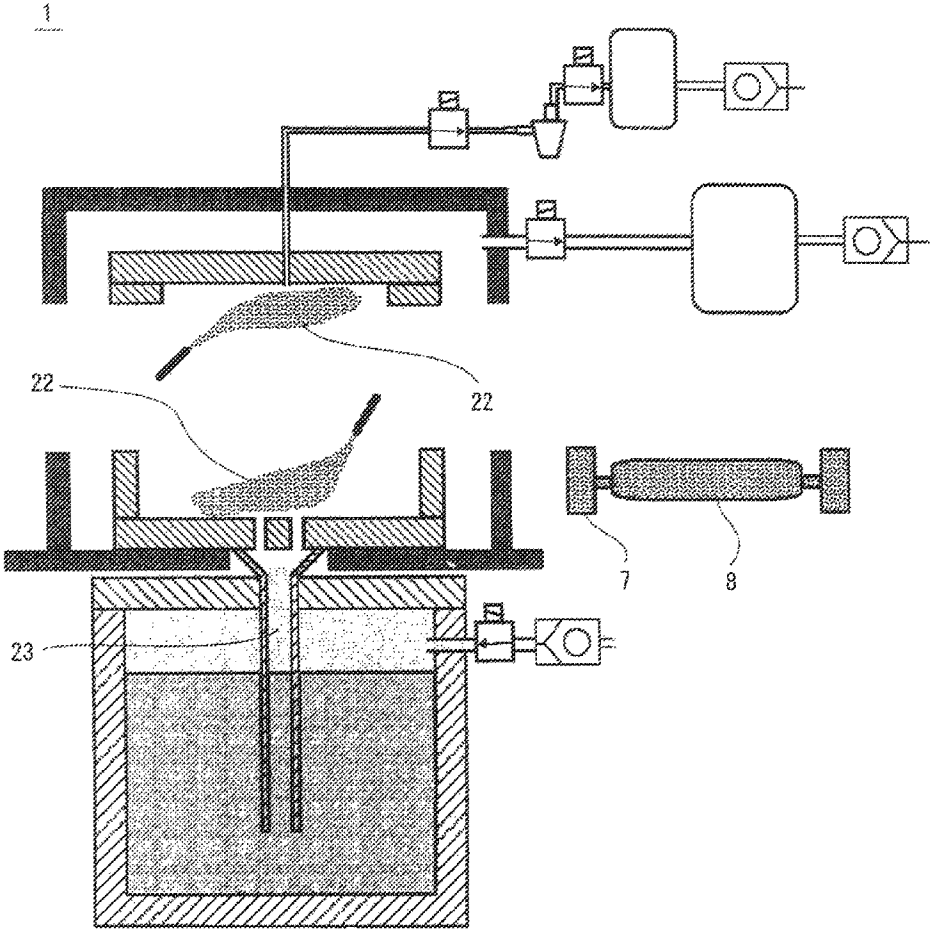
FIG. 4 is a schematic view of an example of a step of disposing a core in a low-pressure casting method of the present invention.

If necessary, a releasing powder 22 may be applied to the inner wall of the mold 6 as illustrated in FIG. 4 before the disposal of the core 8. The releasing powder 22 can be applied by an applying method known in the art such as spraying.

Before the mold 6 is closed, the cavity 9 may be partly opened in a half-closed condition so that gas can flow into the cavity 9, and cavity 9 may be vacuumed in this condition by means of the decompressor 14 that is directly connected to the cavity 9. Such preliminary vacuuming of the cavity 9 in the half-closed condition enables removing the releasing powder 21 that is not adhered to the casting surface, foreign substances that was incorporated when the core was disposed, and the like.

It is preferred that the decompressor 14 that is directly connected to the cavity 9 includes a powder separator 20 such as a cyclone separator. With the powder separator 20, it is possible to trap dust in the mold so as to prevent malfunction of a decompression pump.

Figure 5:
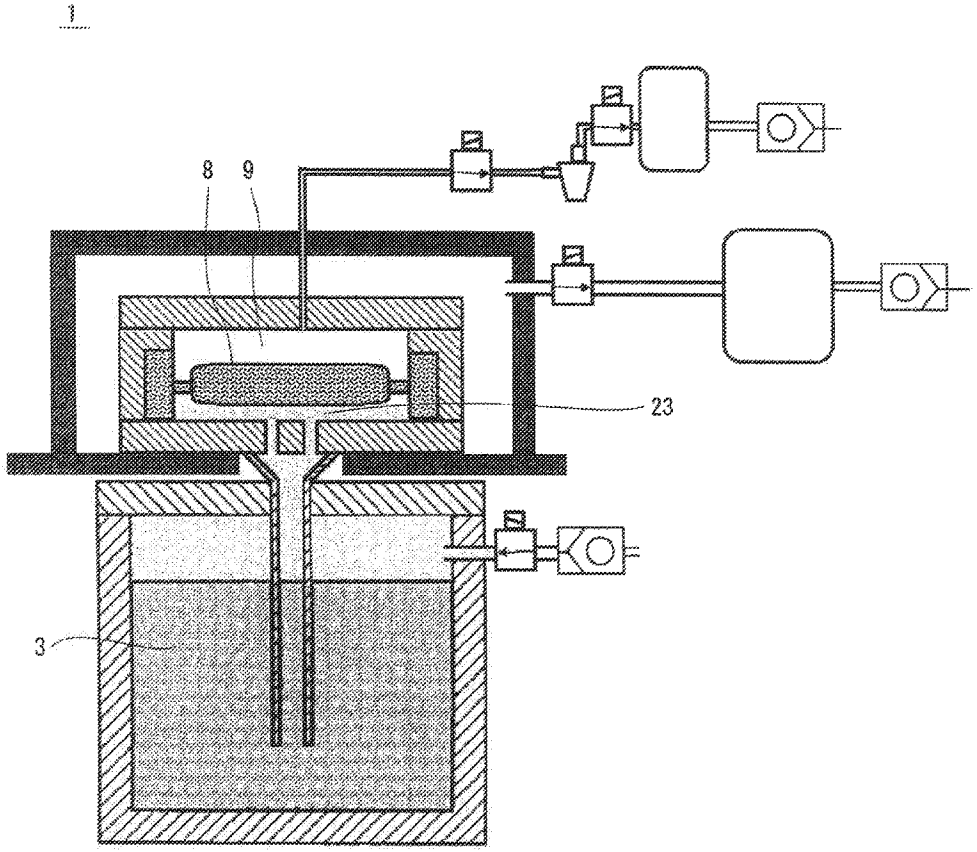
FIG. 5 is a schematic view of an example of a step of closing a mold in the low-pressure casting method of the present invention.

After the mold 6 is closed, hot air 23 that has been heated by the heat of the molten metal 3 rises to increase the temperature in the cavity as illustrated in FIG. 5. The core 8 is heated by the hot air 23 in the cavity and starts to be dried.

Figure 6:
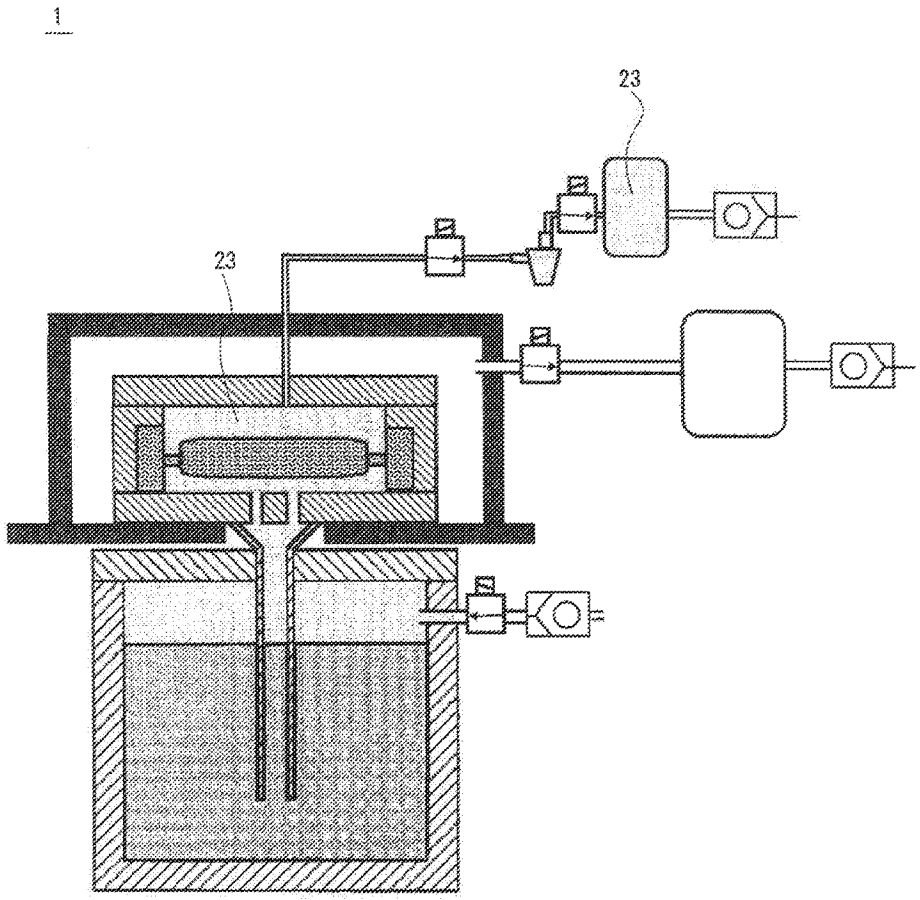
FIG. 6 is a schematic view of an example of a decompression step in the low-pressure casting method of the present invention.

When the valve 17 of the decompressor 14 is opened and the gas in the cavity 9 is suctioned, the hot air 23 is suctioned by the decompressor 14 so that the cavity 9 is filled with the hot air 23 and the pressure in the cavity 9 is reduced as illustrated in FIG. 6. As a result, the increased temperature in combination with the reduced pressure in the cavity promotes evaporation of water in the core 8, and the core 8 is thus rapidly dried.

In the present invention, a core using an inorganic binder may also be used as well as ones using an organic binder including resin. A core using an inorganic binder produces less gas in the casting but has low strength due to low adhesion. However, in the present invention, since the core can be sufficiently dried, the strength of the core using an inorganic binder is improved, and the occurrence of defects caused by core breakage is decreased.

Examples of such inorganic binders include magnesium sulfate ($MgSO_4$), sodium carbonate ($Na_2CO_3$), sodium tetraborate ($Na_2B_4O_7$), sodium sulfate ($Na_2SO_4$) and the like.

Figure 7:
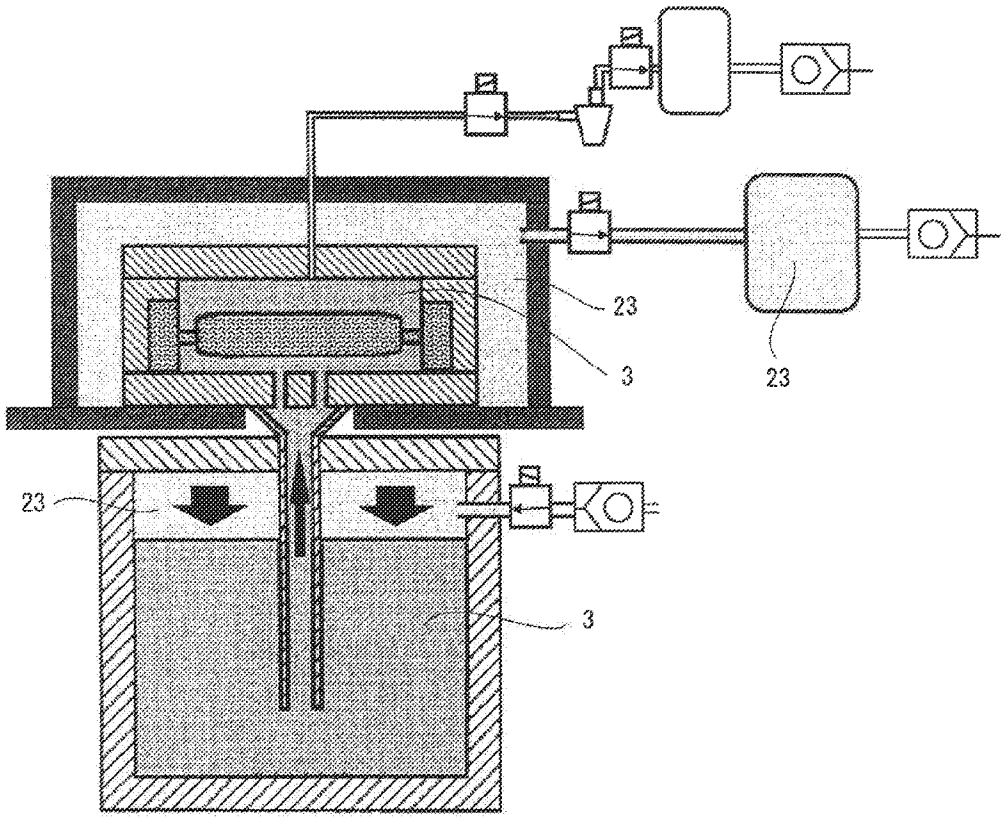
FIG. 7 is a schematic view of an example of a casting step in the low-pressure casting apparatus of the present invention.

Next, as illustrated in FIG. 7, inert gas is pumped into the holding furnace 2 by means of the compressor 10 to apply a pressure on the surface of the molten metal so that the cavity 9 is filled with the molten metal 3 through the stalk 4. Then, when the molten metal 3 is solidified, the mold 6 is opened, and a molded product is collected.

In the present invention, since water in the core 8 is removed beforehand, a reduced amount of gas is produced by the heat of the molten metal 3. This stabilizes the running behavior of the molten metal and thus prevents gas defects and shrinkage cavities.

In the casting step, it is preferred that the cavity 9 is vacuumed while the cavity 9 is being filled with the molten metal 3. The binder of the core 8 may sometimes be evaporated to produce gas due to the heat of the molten metal 3. Therefore, by vacuuming the cavity 9 while filling the cavity 9 with the molten metal 3, the running behavior of the molten metal is stabilized, which prevents gas defects and shrinkage cavities.

Figure 8A:
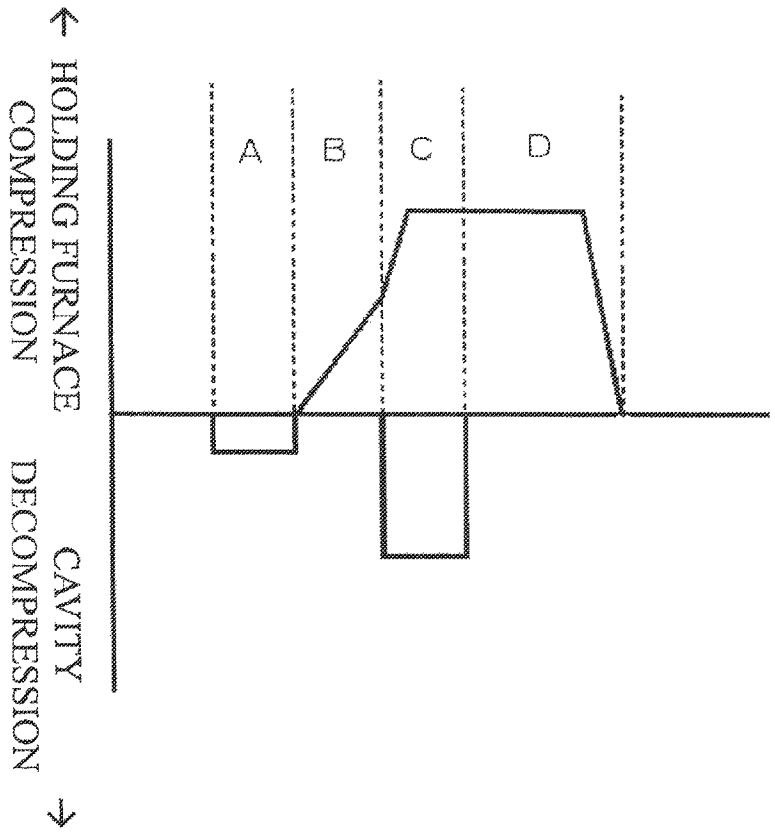
FIGS. 8A and 8B are schematic views of an example of the timing of compression of a holding furnace and decompression of the inside of a mold.

The timing of the compression of the holding furnace 2 and the decompression of the mold 6 will be described with FIG. 8. In FIG. 8A, "A" represents the step of drying the core 8 by hermetically closing the mold 6 and reducing the pressure in the cavity. "B" represents the step of raising the molten metal 3 in the stalk 4 by the first compression of the holding furnace 2. "C" represents the step of switching the compression to the second compression that provides the controlled filling rate and restarting the vacuuming of the mold 6 when the molten metal 3 has reached the gate 5. Once the mold 6 is filled with molten metal 3, the compression of the holding furnace 2 is stopped, and the pressure is maintained at the same level until the molten metal 3 is solidified. In contrast, the vacuuming of the cavity is continued for a certain time even after the mold 6 is filled with the molten metal 3. By continuing the vacuuming, the preceding molten metal containing impurities is discharged from the mold 6 so that the quality of the molded product is improved. "D" represents the step of allowing the molten metal in the mold 6 to solidify. Once the molten metal 3 is solidified, the pressure in the holding furnace 2 is gradually increased, the mold 6 is opened, and the casted product is collected.

Figure 8B:
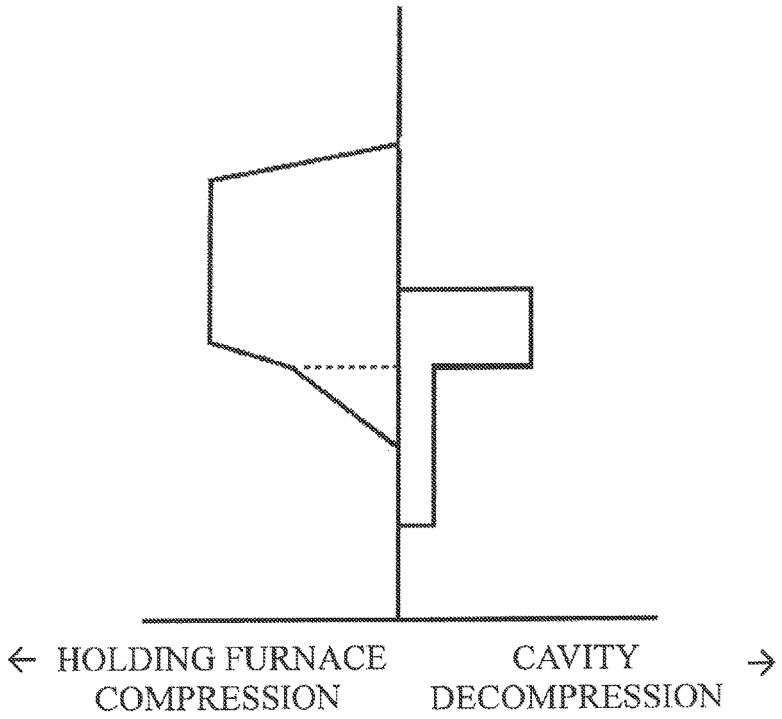

FIG. 8B illustrates an example in which the reduced pressure in the cavity is maintained even while the molten metal 3 in the stalk 4 is raised by means of the first compression of the holding furnace 2.

Figure 9A:
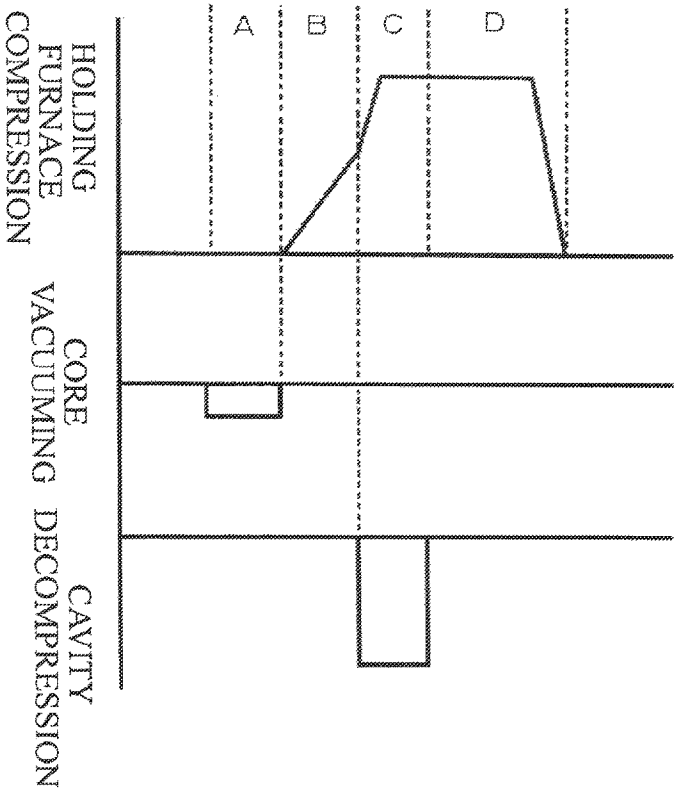
FIGS. 9A and 9B are schematic views of an example of the timing of compression of a holding furnace and decompression of a core and the inside of a mold.

FIG. 9A illustrates the timing of the compression of the holding furnace 2, the decompression of the cavity and the decompression of the core 8 in the case of FIG. 3 in an example in which the suction pipe 11 is connected to the core print 7 for fixing the core 8. The compression of the holding furnace 2 and the decompression of the cavity are the same as those in FIG. 8, and the timing of vacuuming the core 8 will be described.

Figure 9B:
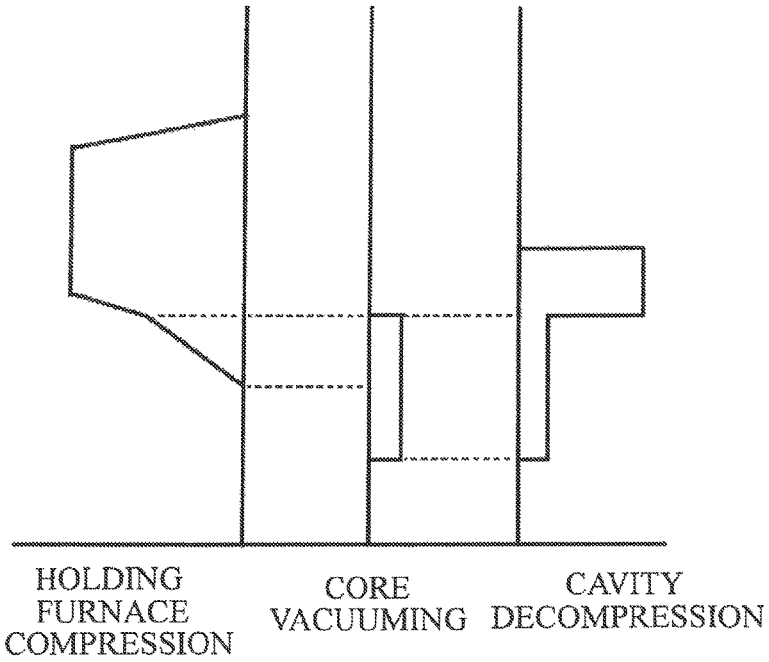

"A" is the step of closing the mold 6 and drying the core 8 by means of suction. As illustrated in FIG. 9B, the drying of the core 8 may be continued while the molten metal is raised in the stalk 4 by means of the first compression of the holding furnace 2 in Step B, but is stopped when the molten metal 3 reaches the gate 5 and starts to flow into the cavity. When the vacuuming of core 8 is continued even after the molten metal 3 flows in, the molten metal 3 may get into the core 8 to cause a sand mark.

While the low-pressure casting apparatus with a single molten metal holding furnace is described as an example, the present invention is not limited thereto. The molten metal holding furnace may be composed of two chambers of a molten metal holding chamber and a compression chamber.

Further, an electromagnetic pump may be employed instead of a compression pump for supplying the molten metal 3.

REFERENCE SINGS LIST

1 Low-pressure casting apparatus
2 Holding furnace
3 Molten metal
4 Stalk
5 Gate
6 Mold
7 Core print
8 Core
9 Cavity
10 Chamber
11 Compressor
12 Compression pump
13 Valve
14 Decompressor
15 Decompression pump
16 Decompression container
17 Valve
18 Suction pipe
19 Suction opening
20 Powder separator
21 Porous body
22 Releasing powder
23 Hot air

The invention claimed is:

1. A low-pressure casting method, comprising:
a core disposing step of disposing a core in a mold;
a mold closing step of closing the mold;
a casting step of increasing pressure in a holding furnace, via a compressor connected thereto, to fill a cavity of the mold with molten metal and allowing the molten metal to solidify; and
a mold opening step of collecting a molded product that is formed in the casting step,
wherein the method further comprises: a reduced-pressure drying step of drying the core under reduced pressure after the mold closing step and before the casting step.

2. The low-pressure casting method according to claim 1, further comprising:
a releasing agent applying step of applying a releasing agent to the mold before the mold closing step.

3. The low-pressure casting method according to claim 1, wherein the casting step involves vacuuming the cavity while filling the cavity with the molten metal.

4. A low-pressure casting apparatus, comprising:
a mold;
a core that together with the mold forms a cavity;
a holding furnace configured to hold molten metal;
a stalk with a lower end dipped in the molten metal in the holding furnace, configured to fill the mold with the molten metal; and
a compressor connected to the holding furnace and configured to increase a pressure in the holding furnace so as to fill the cavity with the molten metal through the stalk,
wherein the low-pressure casting apparatus further comprises: a decompressor configured to reduce a pressure in the cavity, and
the core is dried under reduced pressure after the mold is closed and before the cavity is filled with the molten metal.

5. The low-pressure casting apparatus according to claim 4, wherein the mold has a plurality of suction openings.

6. The low-pressure casting apparatus according to claim 5, wherein one of the plurality of suction openings is formed in the cavity, and the rest of the plurality of suction openings is formed in a porous body that is disposed at a location where a core print for fixing the core is disposed.

7. The low-pressure casting apparatus according to claim 4, wherein a releasing agent is applied to a mold.

8. The low-pressure casting apparatus according to claim 4, wherein the cavity is vacuumed while the cavity is filled with the molten metal.

9. The low-pressure casting apparatus according to claim 4, wherein the core is shaped by using an inorganic binder.

* * * * *